US008497465B2

(12) United States Patent
Hammond

(10) Patent No.: US 8,497,465 B2
(45) Date of Patent: Jul. 30, 2013

(54) ORIENTATION SENSING SWITCH SYSTEM FOR A HEAD-MOUNTED ELECTRONIC DEVICE

(75) Inventor: John Barnett Hammond, Roanoke, VA (US)

(73) Assignee: Exelis, Inc., McLean, VA (US)

( * ) Notice: Subject to any disclaimer, the term of this patent is extended or adjusted under 35 U.S.C. 154(b) by 369 days.

(21) Appl. No.: 12/789,703

(22) Filed: May 28, 2010

(65) Prior Publication Data

US 2011/0289661 A1 Dec. 1, 2011

(51) Int. Cl.
*G01V 8/20* (2006.01)
*G01J 1/32* (2006.01)

(52) U.S. Cl.
USPC ..... 250/221; 250/559.29; 250/205

(58) Field of Classification Search
USPC ..... 250/221, 214 VT, 216, 205, 559.29, 250/559.32; 359/811, 815, 817, 630, 408; 2/410, 5, 6.1, 6.2, 6.3, 6.6, 6.7–8.8, 15, 10, 2/427–454, 9, 422; 313/523, 524
See application file for complete search history.

(56) References Cited

U.S. PATENT DOCUMENTS

| | | | | |
|---|---|---|---|---|
| 5,408,086 | A | 4/1995 | Morris | |
| 5,506,730 | A | 4/1996 | Morley et al. | |
| 6,087,660 | A * | 7/2000 | Morris et al. | 250/330 |
| 6,862,748 | B2 | 3/2005 | Prendergast | |
| 7,128,434 | B1 | 10/2006 | Nally et al. | |
| 7,219,370 | B1 | 5/2007 | Teetzel et al. | |
| 7,221,263 | B2 * | 5/2007 | Moore et al. | 340/427 |
| 7,504,918 | B2 | 3/2009 | Prendergast et al. | |
| 2003/0207718 | A1 | 11/2003 | Perlmutter | |
| 2007/0057068 | A1 * | 3/2007 | Tsai | 235/472.01 |
| 2007/0247296 | A1 | 10/2007 | Moore et al. | |
| 2011/0043492 | A1 * | 2/2011 | Elsasser et al. | 345/179 |

OTHER PUBLICATIONS

Freescale Semiconductor: "MMA7361L," Technical Data, Apr. 1, 2008, pp. 1-11 (http://www.freescale.com/files/sensors/doc/data_sheet/MMA7361L.pdf).
International Search Report issued in PCT/US2011/036912 filed May 18, 2011, mailed Sep. 12, 2011.

* cited by examiner

*Primary Examiner* — Pascal M Bui Pho
(74) *Attorney, Agent, or Firm* — RatnerPrestia

(57) ABSTRACT

Helmet-mounted switch systems are disclosed. A helmet-mounted switch system comprises a mount portion, an electronic device, a power source, at least one accelerometer, and a processor. The mount portion is rotatable around a rotation axis. The electronic device is mounted to the mount portion. The power source is configured to switchably supply power to the electronic device. The at least one accelerometer is operable to measure an acceleration of the mount portion. The system may also include at least one gyroscope operable to measure a rotation of the mount portion. The processor is configured to receive acceleration data. The processor is programmed to determine whether the mount portion is rotating around the rotation axis based on the acceleration data. The processor is programmed to change a power state of the electronic device when the mount portion is rotating around the rotation axis.

16 Claims, 5 Drawing Sheets

130

200

ORIENTATION SENSING SWITCH SYSTEM FOR A HEAD-MOUNTED ELECTRONIC DEVICE

FIELD OF THE INVENTION

The present invention is related to helmet mounted devices, and more particularly, to switch systems for helmet mounted devices.

BACKGROUND OF THE INVENTION

Head or helmet mounts allow electronic devices, such as lights, cameras, or night vision devices, to be mounted on the head or helmet of a user. For certain electronic devices, such as night vision devices, it may be desirable that a head or helmet mount enable the electronic device to be positioned in front of the user's eye. The user can thereby view his or her surroundings through the night vision device, while keeping his or her hands free to perform various tasks.

Conventional head or helmet mounts may enable the electronic device to be moved between an active position, e.g., a position in front of the user's eye, and a stowed position, e.g., a position clear of the user's field of vision. When the electronic device is moved to the stowed position, it may no be longer in use. Thus, it may be desirable for the electronic device to automatically power down or enter a standby mode when it is moved to the stowed position. There exists a need for improved switch systems for automatically shutting off helmet mounted electronic devices.

SUMMARY OF THE INVENTION

Aspects of the present invention are directed to switch systems for helmet mounted devices.

In accordance with one aspect of the present invention, a helmet-mounted switch system is disclosed. The helmet-mounted switch system comprises a mount portion, an electronic device, a power source, a plurality of accelerometers, and a processor. The mount portion is rotatable around a rotation axis. The electronic device is mounted to the mount portion. The power source is configured to switchably supply power to the electronic device. The plurality of accelerometers are operable to measure an acceleration of the mount portion. The processor is configured to receive acceleration data from the plurality of accelerometers. The processor is programmed to determine whether the mount portion is rotating around the rotation axis based on the acceleration data. The processor is programmed to change a power state of the electronic device when the mount portion is rotating around the rotation axis.

In accordance with another aspect of the present invention, a method for operating a helmet-mounted switch system is disclosed. The helmet-mounted switch system includes a mount portion rotatable around a rotation axis and an electronic device mounted to the mount portion. The method comprises the steps of measuring an acceleration of the mount portion, determining whether the mount portion is rotating around the rotation axis based on the measured acceleration, and changing a power state of the electronic device when the mount portion is rotating around the rotation axis.

In accordance with still another aspect of the present invention, an electronic device is disclosed. The electronic device is configured to be mounted to a mount portion of a helmet, the mount portion rotatable around a rotation axis. The electronic device comprises a power source, a plurality of accelerometers, and a processor. The power source is configured to switchably supply power to the electronic device. The plurality of accelerometers are coupled to the electronic device for measuring the acceleration of the electronic device. The processor is configured to receive acceleration data from the plurality of accelerometers. The processor is programmed to determine whether the mount portion is rotating around the rotation axis based on the acceleration data. The processor is programmed to change a power state of the electronic device when the mount portion is rotating around the rotation axis.

In accordance with yet another aspect of the present invention, a helmet-mounted switch system is disclosed. The helmet-mounted switch system comprises a mount portion, an electronic device, a power source, at least one accelerometer, at least one gyroscope, and a processor. The mount portion is rotatable around a rotation axis. The electronic device is mounted to the mount portion. The power source is configured to switchably supply power to the electronic device. The at least one accelerometer is operable to measure an acceleration of the mount portion. The at least one gyroscope is operable to measure a rotation of the mount portion. The processor is configured to receive acceleration data from the at least one accelerometer and rotation data from the at least one gyroscope. The processor is programmed to determine whether the mount portion is rotating around the rotation axis based on the acceleration data and the rotation data. The processor is programmed to connect or disconnect the electronic device from the power supply when the mount portion is rotating around the rotation axis.

BRIEF DESCRIPTION OF THE DRAWINGS

The invention may be best understood from the following detailed description when read in connection with the accompanying drawings. It is emphasized that, according to common practice, the various features of the drawings are not to scale. On the contrary, the dimensions of the various features may be arbitrarily expanded or reduced for clarity. Included in the drawings are the following figures.

DETAILED DESCRIPTION OF THE INVENTION

Figure 1B:
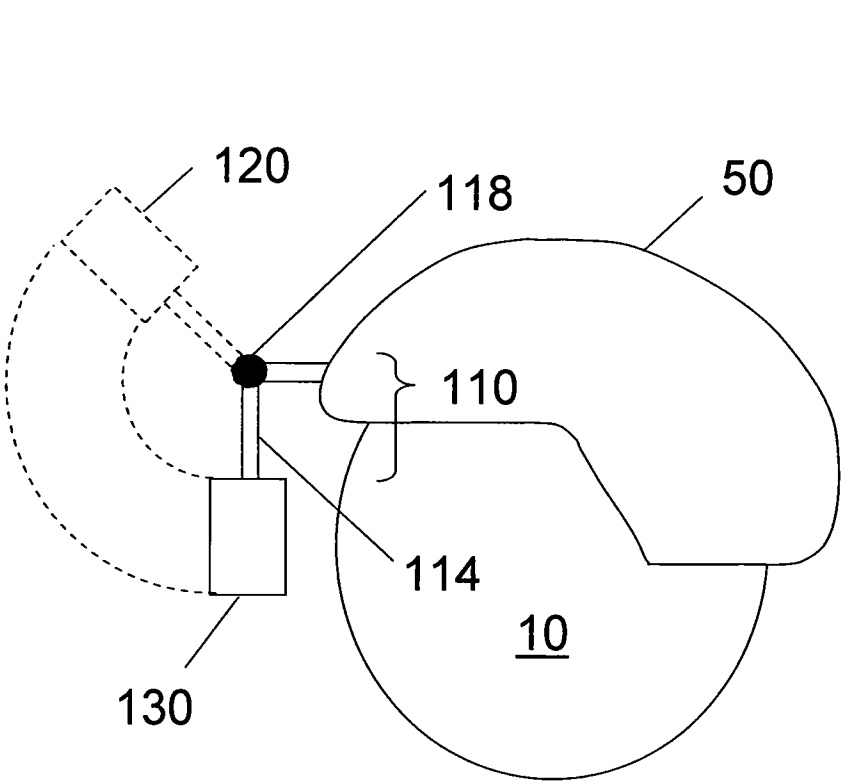
FIG. 1B is a diagram side view of the helmet-mounted electronic device of FIG. 1A.

The exemplary switch systems and methods disclosed herein are suitable for use with helmets that include helmet mounts for mounting electronic devices. Suitable helmets may include helmet mounts that are operable to move the mounted electronic device between a stowed position and an active position, e.g., by rotation around a rotation axis. As used herein, the words helmet, helmet mount, and helmet mounted systems are meant to refer to any device, mount or systems adapted is to be coupled to the head of a user.

Referring now to the drawings, FIGS. 1A-4 illustrate a helmet-mounted switch system 100 in accordance with aspects of the present invention. The helmet-mounted switch system 100 is adapted to be coupled to a helmet 50 that is worn on the head of a user 10. As a general overview, helmet-mounted switch system 100 includes a mount portion 110, an electronic device 130, a power source 150, a plurality of accelerometers 170, and a processor 190. Additional details of switch system 100 are described below.

Figure 1A:
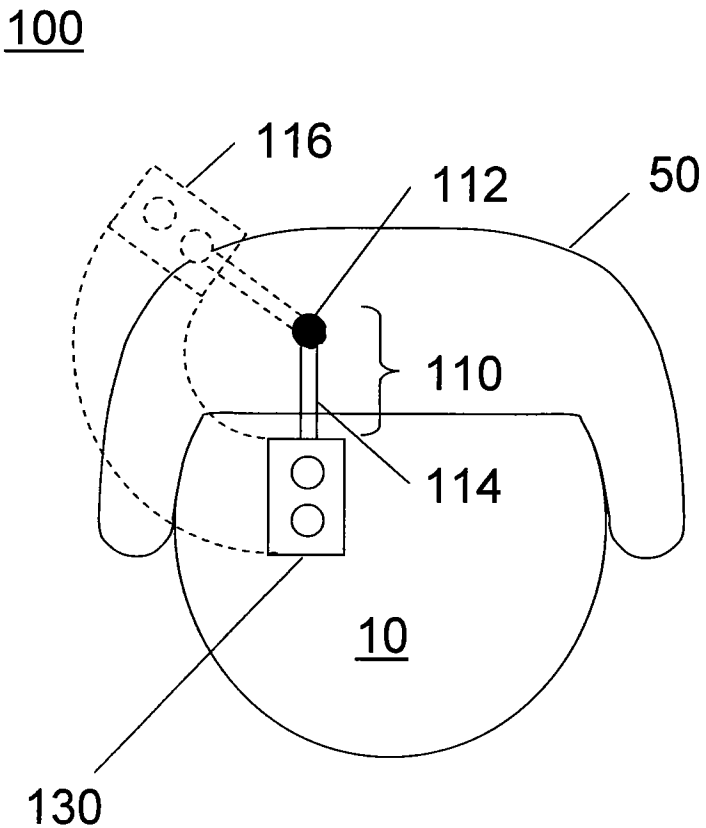
FIG. 1A is a diagram front view of an exemplary helmet-mounted electronic device in accordance with aspects of the present invention.

Mount portion 110 is coupled to helmet 50, as illustrated in FIGS. 1A and 1B. Mount portion 110 is configured to receive an electronic device to be mounted to helmet 50. Mount portion 110 may be adapted to move the electronic device between an active position and a stowed position. In an exemplary embodiment, mount portion 110 is a rotatable helmet mount. Mount portion 110 is rotatable around a rotation axis 112. As illustrated in FIG. 1A, mount portion 110 may be rotatable around rotation axis 112 between an active position 114 and a stowed position 116.

In a further exemplary embodiment, mount portion 110 is rotatable around another rotation axis 118. As illustrated in FIG. 1B, mount portion 110 may be rotatable around rotation axis 118 between the active position 114 and a stowed position 120. Stowed position 120 may be the same as or different from stowed position 116. Mount portion 110 may be rotatable around one or both of rotation axes 112 and 118. Thereby, mount portion 110 may be rotatable in two different rotational directions around axes 112 and 118, respectively, as illustrated in FIGS. 1A and 1B.

While illustrated as rotating in one or two directions of rotation, it will be understood that mount portion 110 may be rotatable around a third axis in a third direction of rotation. Rotation of mount portion 110 around a third axis will be understood to one of ordinary skill in the art from the description herein.

Suitable rotatable helmet mounts for use as mount portion 110 include, for example, the Norotos INVG Mount, P/N 1820010. Other suitable helmet mounts for use as mount portion 110 will be known by one of ordinary skill in the art from the description herein.

Figure 2:
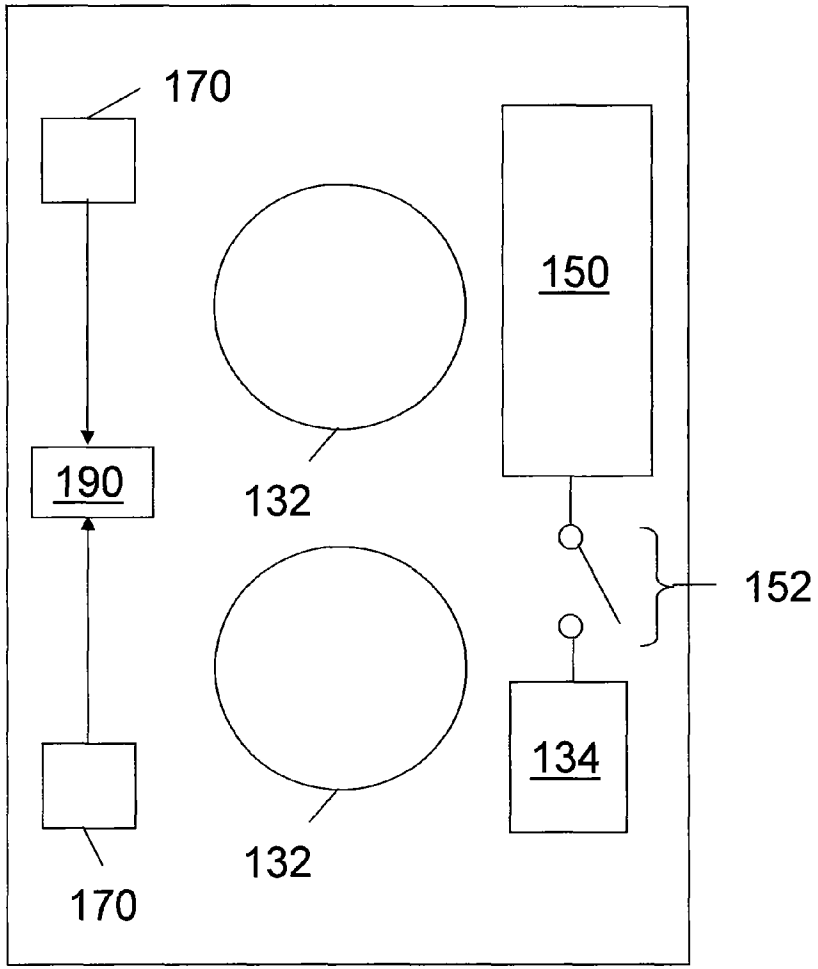
FIG. 2 is a diagram view of an exemplary electronic device in accordance with aspects of the present invention.

Electronic device 130 is configured to be mounted to mount portion 110, as illustrated in FIGS. 1A and 1B. Electronic device 130 may be a device that is configured for positioning in front of the eye of user 10. In an exemplary embodiment, electronic device 130 is a night vision device, as illustrated in FIG. 2. The night vision device 130 may include one or more optical inputs 132 for receiving an image of a forward field of view. Suitable night vision devices for use as electronic device 130 will be known by one of ordinary skill in the art from the description herein.

Power source 150 is configured to switchably supply power to electronic device 130. Power source 150 may be integrated with or incorporated into electronic device 130, as illustrated in FIG. 2. Nonetheless, while power source 150 is illustrated as an internal component of electronic device 130, it will be understood that power source 150 may be a component external to electronic device 130. For example, power source 150 may be coupled to helmet 50, and electrically connected with electronic device 130 in order to power electronic device 130.

In an exemplary embodiment, power source 150 is a battery configured to power electronic device 130. The battery is incorporated into the electronic device 130.

Power source 150 may further include at least one switch 152, as illustrated in FIG. 2. Switch 152 is connected between power source 150 and the electronic components of electronics device 130 (generally referred to as 134 in FIG. 2), and controls whether the components 134 of electronic device 130 receive power from power source 150. Thus, switch 152 may be actuated in order to turn electronic device 130 on and off. In an exemplary embodiment, switch 152 may be a mechanical relay. Switch 152 may be electrically actuated, as will be described herein. While only a single switch 152 is illustrated, it will be understood that multiple switches 152 may be used to control power to multiple different circuits in electronic device 130.

Accelerometers 170 are coupled to one of the mount portion 110 and the electronic device 130. Accelerometers 170 may be affixed to one or both of mount portion 110 and electronic device 130. In an exemplary embodiment, accelerometers 170 are integrated with or incorporated into electronic device 130, as illustrated in FIG. 2. Nonetheless, while accelerometers 170 are illustrated as internal components of electronic device 130, it will be understood that accelerometers 170 may alternatively or additionally be coupled to mount portion 110. Accelerometers 170 may be powered by power source 150. Alternatively, accelerometers 170 may be powered by a separate power source. Accelerometers 170 may desirably be coupled such that they continue to receive power even when electronic device 130 has been powered down or placed in standby mode. Thus, accelerometers 170 will be able to sense movement of electronic device from the stowed position 116 to the active position 114, as will be explained herein.

Accelerometers 170 are operable to measure the acceleration of one or both of the mount portion 110 and the electronic device 130. Accelerometers 170 may be operable to measure acceleration along one or multiple different axes.

In an exemplary embodiment, accelerometers 170 are dual axis MicroElectroMechanical Systems (MEMS) accelerometers. Accelerometers 170 have two measurement axes, i.e., they measure acceleration in two directions. Accelerometers 170 output a signal representing the acceleration measured in each direction. Suitable MEMS accelerometers for use as accelerometers 170 include, for example, the Analog Devices ADXL 335 3 Axis Accelerometer, or the Freescale MMA 7361L 3 Axis Accelerometer. Other suitable accelerometers for use as accelerometers 170 will be known by one of ordinary skill in the art from the description herein.

The positioning and orientation of accelerometers 170 may be important for detecting the movement of electronic device 130 when it is mounted to mount portion 110, as will be described herein.

Figure 3:
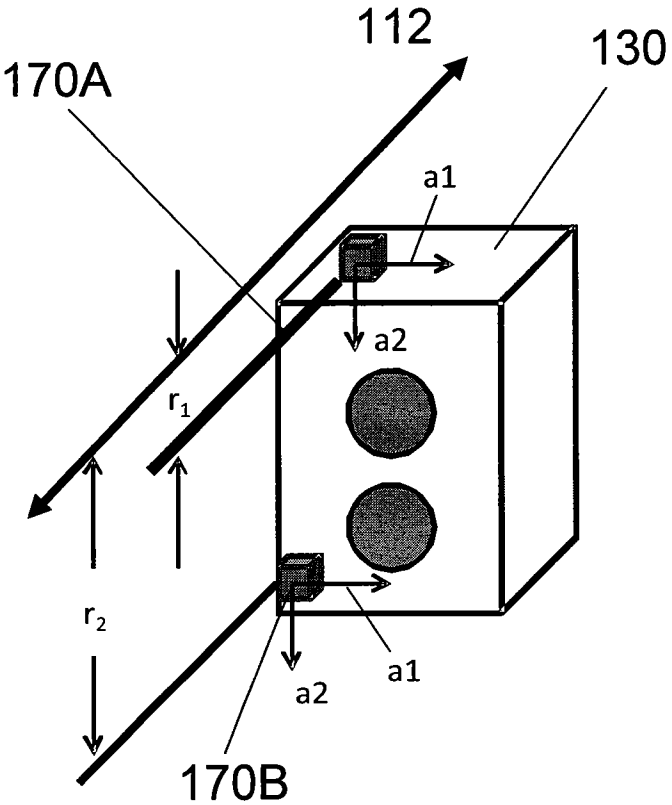
FIG. 3 is a diagram perspective view of an exemplary accelerometer configuration in accordance with aspects of the present invention.

The positioning of accelerometers 170 may be selected based on the location of the rotation axis of mount portion 110, as will be described below with reference to FIG. 3. In an exemplary embodiment, a first accelerometer 170A is positioned at a first distance r1 from rotation axis 112. A second accelerometer 170B is positioned at a second distance r2 from rotation axis 112. This may enable switch system 100 to identify when mount portion 110 is rotating around rotation axis 112.

Figure 4:
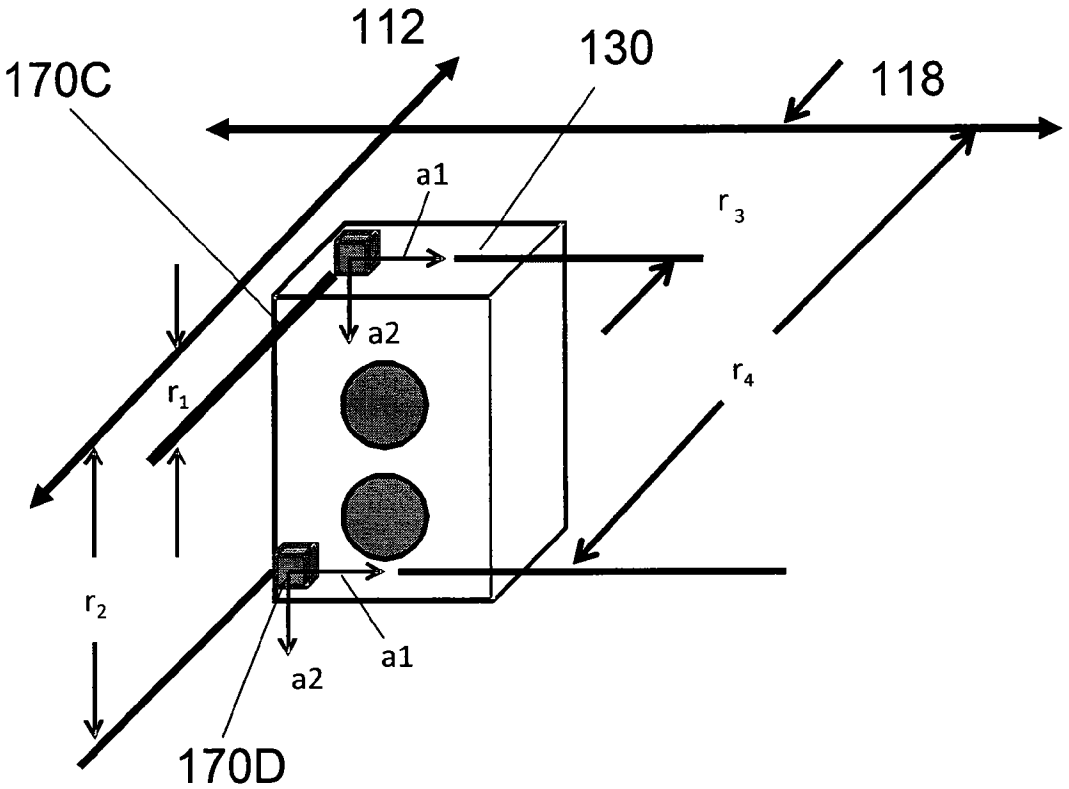
FIG. 4 is a diagram perspective view of an exemplary accelerometer configuration in accordance with aspects of the present invention.

In a further exemplary embodiment, mount portion 110 may be rotatable around multiple rotation axes 112 and 118, as illustrated in FIG. 4. Here, a first accelerometer 170C is positioned at a first distance r1 from rotation axis 112 and is a first distance r3 from rotation axis 118. A second accelerometer 170D is positioned at a second distance r2 from rotation axis 112 and a second distance r4 from rotation axis 118. This may enable switch system 100 to identify when mount portion 110 is rotating around rotation axis 112 and when mount portion is rotating around rotation axis 118. It will be understood that when mount portion 110 is rotatable around a third rotation axis, accelerometers 170C and 170D may be positioned at different distances from the third rotation axis, substantially as described above.

In addition to position, the orientation of accelerometers 170 may be selected based on the direction of rotation of mount portion 110, as will be described below with reference to FIGS. 3 and 4. In an exemplary embodiment, accelerometer 170A has a measurement axis a1. The measurement axis a1 is oriented in a direction substantially tangential to the direction of rotation of mount portion 110 around rotation axis 112. This may allow accelerometer 170A to more easily measure when mount portion 110 is rotating about its rotation axis 112.

In a further exemplary embodiment, mount portion 110 is rotatable around multiple rotation axes 112 and 118, and accelerometer 170C has multiple measurement axes a1 and a2, as illustrated in FIG. 4. The measurement axis a1 is oriented in a direction substantially tangential to the first direction of rotation of mount portion 110 around rotation axis 112, and measurement axis a2 is oriented in a direction substantially tangential to the second direction of rotation of mount portion 110 around rotation axis 118. This may also allow accelerometer 170C to more easily measure when mount portion 110 is rotating about its rotation axis 112 or when mount portion 110 is rotating about its rotation axis 118.

For dual axis accelerometers 170, the second measurement axis may optionally be used to measure the gravity vector experienced by mount portion 110 or electronic device 130. Thereby, the relative orientation of mount portion 110 or electronic device 130 may be determined. This may enable the determination of whether mount portion 110 is in the active position 114 or the stowed position 116. This may be desirable for mount portions 110 having only a single rotation axis 112.

In an alternative embodiment, at least one of the accelerometers 170 may be replaced with a gyroscope (not shown). A combination of accelerometer(s) and gyroscope(s) may be integrated with or incorporated into electronic device 130. Such a combination of accelerometers and gyroscopes may be referred to as an inertial measurement unit (IMU). In the IMU, the one or more accelerometers 170 may be configured to measure the acceleration of either the mount portion 110 or the electronic device 130, and the one or more gyroscopes may be configured to measure the rotation of either the mount portion 110 or the electronic device 130. Thereby, it may be determined whether mount portion 110 is rotating around rotation axis 112.

A processor 190 is configured to receive acceleration data measured by the plurality of accelerometers 170. Processor 190 may be integrated with or incorporated into electronic device 130, as illustrated in FIG. 2. Processor 190 may be powered by power source 150. In an exemplary embodiment, processor 190 is a microprocessor. However, processor 190 may be any circuit configured to receive data from accelerometers 170 and process the data. Suitable microprocessors for use as processor 190 will be known by one of ordinary skill in the art from the description herein.

Processor 190 is programmed to determine whether mount portion 110 is rotating around a rotation axis based on the acceleration data received from accelerometers 170. An exemplary algorithm for determining whether mount portion 110 is rotating is described below with reference to FIG. 3.

It may be predetermined that when mount portion 110 is rotated around rotation axis 112, the relative accelerations measured by accelerometers 170A and 170B will be in the ratio of approximately r1/r2. Conversely, when user 10 moves his or her head or body, the accelerations experienced by accelerometers 170A and 170B will not correspond to above ratio, as the user's movements will generally not be around rotation axis 112. This may allow for the differentiation of the movements of mount portion 110.

When electronic device 130 moves, accelerometers 170A and 170B measure an acceleration, and communicate their respective measured acceleration data to processor 190. Thus, when processor 190 determines that the measured accelerations received from accelerometers 170A and 170B have a ratio approximately equivalent to r1/r2, then processor 190 may determine that the measured acceleration corresponds to the rotation of mount portion 110 around rotation axis 112. Conversely, when processor 190 determines that the measured accelerations received from accelerometers 170A and 170B have a ratio substantially different from r1/r2, then processor 190 may determine that the measured acceleration corresponds to a different movement of mount portion 110, e.g., a movement of helmet 50, to which mount portion 110 is attached. Thus, processor 190 may be operable to determine whether a measured movement of electronic device 130 or mount portion 110 corresponds to a rotation of mount portion 110 around rotation axis 112 or to a movement of helmet 50.

Similar exemplary algorithms may be employed by processor 190 when mount portion 110 is rotatable around multiple rotation axes 112 and 118, as illustrated in FIG. 4. It may be predetermined that when mount portion 110 is rotated around rotation axis 112, the relative accelerations measured by accelerometers 170C and 170D will be in the ratio of approximately r1/r2. Similarly, it may be predetermined that when mount portion 110 is rotated around rotation axis 118, the relative accelerations measured by accelerometers 170C and 170D will be in the ratio of approximately r3/r4. Conversely, when user 10 moves his or her head or body, the accelerations experienced by accelerometers 170C and 170D will not correspond to the above ratios, as the user's movements will generally not be around rotation axis 112 or rotation axis 118. This may allow for the differentiation of the movements of mount portion 110.

Thus, when processor 190 determines that the measured accelerations received from accelerometers 170C and 170D have a ratio approximately equivalent to either of the above ratios, then processor 190 may determine that the measured acceleration corresponds to the rotation of mount portion 110 around the corresponding rotation axis. Conversely, when processor 190 determines that the measured accelerations received from accelerometers 170A and 170B have a ratio substantially different from the above ratios, then processor 190 may determine that the measured acceleration corresponds to a different movement of mount portion 110, e.g., a movement of helmet 50, to which mount portion 110 is attached. Thus, processor 190 may be operable to determine whether a measured movement of electronic device 130 or mount portion 110 corresponds to a rotation of mount portion 110 around rotation axis 112, a rotation of mount portion 110 around rotation axis 118, or to a movement of helmet 50.

It will be understood that different mount portions 110 may rotate around a rotation axis in different ways. Accordingly, processor 190 may be programmed to allow a tolerance in determining whether a measured acceleration corresponds to the above ratios.

Additionally, processor 190 may be programmed to determine the range of movement of mount portion 110 based on the measured acceleration data from accelerometers 170. It will be understood that movements of user 10 or helmet 50 worn by user 10 may be limited in angular range. Thus. if a movement measured by accelerometers 170 exceeds a predetermined range or angular distance, processor 190 may determine that the movement corresponds to a rotation of mount portion 110, as opposed to a movement of helmet 50. Thereby, processor 190 may be programmed to determine whether a measured acceleration corresponds to a rotation of mount portion 110 or corresponds to a movement of helmet 50 based on the range of movement of electronic device 130 measured by accelerometers 190. This process may be combined with the above-described algorithms to determine with greater accuracy whether mount portion 110 is rotating around a rotation axis.

Processor 190 is programmed to change a power state of electronic device 130 when processor 190 determines that mount portion 110 is rotating around a rotation axis. In an exemplary embodiment, processor 190 is electrically connected with switch 152. When processor 190 determines that mount portion 110 is rotating around rotation axis 112, processor 190 is programmed to transmit a signal to actuate switch 152, thereby connecting or disconnecting electronic device 130 from power supply 150. Likewise, if mount portion 110 is rotatable around multiple rotation axes 112 and 118, then when processor 190 determines that mount portion 110 is rotating around either rotation axis 112 or rotation axis 118, processor 190 is programmed to transmit a signal to actuate switch 152, thereby connecting or disconnecting electronic device 130 from power supply 150.

Further, processor 190 may be programmed to determine whether the mount portion 110 is rotating into the active position 114 or the stowed position 116. In an exemplary embodiment, processor 190 determines whether the mount portion 110 is rotating into the active position 114 or the stowed position 116 based on the direction (or polarity) of the acceleration measured by accelerometers 170 when it is determined that mount portion 110 is rotating around a rotation axis. When processor 190 determines that mount portion 110 is being rotated into the active position 114, processor 190 is programmed to transmit a signal to activate switch 152, thereby connecting electronic device 130 with power supply 150. This may enable electronic device 130 to be automatically turned on when electronic device 130 is rotated into the active position 114 by user 10. Conversely, when processor 190 determines that mount portion 110 is being rotated into the stowed position 116, processor 190 is programmed to transmit a signal to deactivate switch 152, thereby disconnecting electronic device 130 from power supply 150. This may enable electronic device 130 to be automatically turned off when electronic device 130 is rotated into the stowed position 116 by user 10. Additionally, it will be understood that instead of disconnecting electronic device 130, electronic device 130 may be changed to a low power state, e.g. a standby mode, when electronic device 130 is rotated into the stowed position 116. This may enable systems on standby mode to be quickly powered on when electronic device is rotated from the stowed position 116 to the active position 114.

Figure 5:
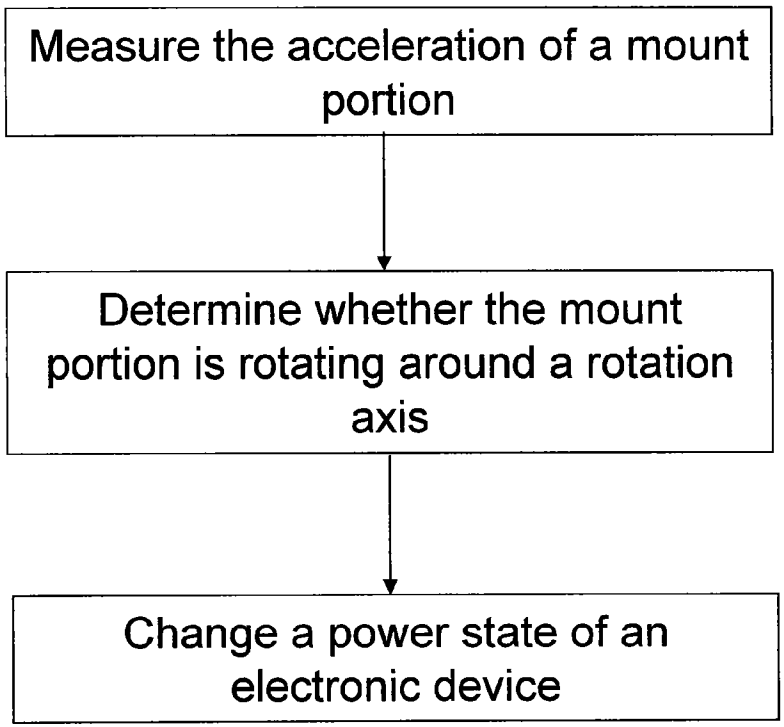
FIG. 5 is a flow chart of an exemplary method for operating a helmet-mounted switch system in accordance with aspects of the present invention.

FIG. 5 illustrates a method 200 for operating a helmet-mounted switch system in accordance with aspects of the present invention. The helmet-mounted switch system includes a mount portion rotatable around a rotation axis and an electronic device mounted to the mount portion. As a general overview, method 200 includes measuring an acceleration, determining whether the mount portion is rotating, and connecting or disconnecting the electronic device from a power supply. Additional details of method 200 are described below.

In step 210, an acceleration is measured. In an exemplary embodiment, the acceleration of either mount portion 110 or electronic device 130 are measured with accelerometers 170. A first accelerometer 170A may measure the acceleration at a first distance r1 from rotation axis 112, and a second accelerometer 170B may measure the acceleration at a second distance r2 from rotation axis 112, as described above with respect to FIG. 3. Alternatively, when the mount portion 110 is rotatable around multiple rotation axes 112 and 118, a first accelerometer 170C may measure the acceleration at a first distance r1 from rotation axis 112 and a first distance r3 from rotation axis 118, and a second accelerometer 170D may measure the acceleration at a second distance r2 from rotation axis 112 and a second distance r4 from rotation axis 118, as described above with respect to FIG. 4. Additionally, an accelerometer 170 may include a measurement axis a1 oriented in a direction tangential to the direction of rotation of mount portion 110, as described above with respect to FIGS. 3 and 4.

In step 230, it is determined whether the mount portion is rotating. In an exemplary embodiment, processor 190 determines whether the mount portion 110 is rotating around a rotation axis based on the accelerations measured by accelerometers 170. Processor 190 may determine whether the mount portion 110 is rotating using the above-described algorithms. Processor 190 may further be programmed to determine whether the mount portion 110 is rotating around a rotation axis 112, whether mount portion 110 is rotating around rotation axis 118, or whether helmet 50 is moving, as described above.

In step 250, a power state of the electronic device is changed. In an exemplary embodiment, processor 190 connects or disconnects electronic device 130 with power supply 150 when processor 190 determines that mount portion 110 is rotation around the rotation axis. Alternatively, electronic device 130 may be switched between a normal mode and a standby mode when processor 190 determines that mount portion 110 is rotation around the rotation axis.

The above-described systems and methods may provide a number of advantages over conventional helmet-mounted switch systems. For example, convention systems may use mechanical switches to automatically turn on and off an association electronic device. These switches may utilize mechanical contacts to open or close the switch as the helmet mount moves between an active and stowed position. Mechanical switches may suffer from reliability issues and in the complexity of mounting and alignment. The incorporation of mechanical switches into the helmet mount may increase the helmet's complexity and cost, and reduce reliability. Additionally, mechanical switches such as level sensors or tilt sensors may be unable to distinguish between the movement of the mount portion between positions and a movement of the user's head.

To the contrary, the disclosed systems and methods may incorporate one or more accelerometers mounted inside an electronic device, thereby eliminating the need for electrical interconnection through the wall of the electronic device. The exemplary MEMS accelerometers are inexpensive and rugged. They may be easily incorporated into other electronic components inside an electronic device, making final incorporation inexpensive. This invention allows both direct reading of accelerations in addition to allowing for signal integration to determine velocity and distance to allow discrimination between movements of the mount portion or electronic device alone, as opposed to a user's head movements.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A head-mounted switch system comprising:

a mount portion rotatable around a rotation axis;

an electronic device mounted to the mount portion;

a power source configured to switchably supply power to the electronic device;

a plurality of accelerometers operable to measure an acceleration of the mount portion; and a processor configured to receive acceleration data from the plurality of accelerometers, wherein the processor is configured to determine whether the mount portion is rotating around the rotation axis based on the acceleration data, the processor is programmed to change a power state of the electronic device when the mount portion is rotating around the rotation axis, the mount portion rotates around a first rotation axis in a clockwise or counterclockwise direction and a second rotation axis around a second rotation axis in an upward or downward direction, at least one of the plurality of accelerometers is positioned at a first distance from the rotation axis, and at least another one of the plurality of accelerometers is positioned at a second distance from the rotation axis different from the first distance, and the processor is configured to determine whether a measured acceleration corresponds to a rotation of the mount portion around the rotation axis or a movement of a user's head associated with the mount portion, based on measured accelerations of both the one and other accelerometers, and the processor includes a module for calculating a ratio, wherein the ratio is calculated between the measured accelerations of the one and other accelerometers, and when the ratio is approximately equal to predetermined ratio between the first and second distances, the module determines that the measured accelerations correspond to a rotation of the mount portion.

2. The switch system of claim 1, wherein:

the electronic device is a night vision device.

3. The switch system of claim 1, wherein:

the plurality of accelerometers are incorporated within the electronic device.

4. The switch system of claim 1, wherein:

the plurality of accelerometers are operable to measure acceleration in a direction substantially tangential to a direction of rotation of the mount portion.

5. The switch system of claim 1, wherein:

the processor is programmed to determine whether the mount portion is rotating into an active position or into a stowed position, the processor is programmed to connect the electronic device to the power supply when the processor determines the mount portion is rotating around into the active position, and the processor is programmed to disconnect the electronic device from the power supply when the processor determines the mount portion is rotating around into the stowed position.

6. The switch system of claim 1, wherein:

the processor is programmed to change the power state of the electronic device when the processor determines the mount portion is rotating around the first rotation axis or the second rotation axis.

7. The switch system of claim 6, wherein:

at least one of the plurality of accelerometers is positioned at a first distance from the first rotation axis and a first distance from the second rotation axis, and at least another one of the plurality of accelerometers is positioned at a second distance from the first rotation axis different from the first distance and at a second distance from the second rotation axis different from the first distance.

8. The switch system of claim 6, wherein:

the processor is programmed to determine whether a measured acceleration corresponds to a rotation of the mount portion around the first rotation axis, a rotation of the mount portion around the second rotation axis, or a movement of a user's head associated with the mount portion.

9. The switch system of claim 1, further comprising:

at least one gyroscope operable to measure a rotation of the mount portion, wherein the processor is programmed to determine whether the mount portion is rotating around the rotation axis based on the acceleration data and rotation data measured by the at least one gyroscope.

10. A method for operating a head-mounted switch system, the head-mounted switch system including a mount portion rotatable around a rotation axis and an electronic device mounted to the mount portion, the method comprising the steps of:

measuring an acceleration of the mount portion;

determining whether the mount portion is rotating around the rotation axis based on the measured acceleration; and changing a power state of the electronic device when the mount portion is rotating around the rotation axis;

wherein the measuring step comprises:

measuring the acceleration of one of the mount portion and the electronic device with a first accelerometer positioned at a first distance from the rotation axis, and measuring the acceleration of one of the mount portion and the electronic device with a second accelerometer positioned at a second distance from the rotation axis different from the first distance; and the determining step comprises:

determining whether the measured acceleration corresponds to a rotation of the mount portion around the rotation axis or a movement of a user's head associated with the mount portion, based on measured accelerations of both, the first and second accelerometers, and wherein a ratio is calculated between the measured accelerations of the first and second accelerometers, and when the ratio is approximately equal to a predetermined ratio between the first and second distances, the processor determines that the measured accelerations correspond to a rotation of the mount portion.

11. The method of claim 10, wherein the measuring step comprises:

measuring the acceleration of the one of the mount portion and the electronic device in a direction tangential to a direction of rotation of the mount portion.

12. The method of claim 10, wherein the mount portion is rotatable around a first rotation axis and a second rotation axis, and wherein the changing step comprises:

connecting or disconnecting the electronic device with a power supply when it is determined that the mount portion is rotating around the first rotation axis or the second rotation axis.

13. The method of claim 12, wherein the measuring step comprises:

measuring the acceleration of one of the mount portion and the electronic device with a first accelerometer positioned at a first distance from the first rotation axis and a first distance from the second rotation axis, and measuring the acceleration of one of the mount portion and the electronic device with a second accelerometer positioned at a second distance from the first rotation axis different from the first distance and a second distance from the second rotation axis different from the first distance.

14. The method of claim 12, wherein the determining step comprises:

determining whether the measured acceleration corresponds to a rotation of the mount portion around the first rotation axis, a rotation of the mount portion around the second rotation axis, or a movement of a user's head associated with the mount portion.

15. An electronic device configured to be mounted to a mount portion of a helmet, the mount portion rotatable around a rotation axis, the electronic device comprising:

a power source configured to switchably supply power to the electronic device;

a plurality of accelerometers coupled to the electronic device for measuring the acceleration of the electronic device, a first accelerometer positioned to measure acceleration at a first distance from the rotation axis, and a second accelerometer positioned to measure acceleration at a second distance from the rotation axis;

a processor configured to receive acceleration data from the plurality of accelerometers, wherein the processor is configured to determine whether the mount portion is rotating around the rotation axis based on the acceleration data measured by both, the first and second accelerometers; and the processor is configured to change a power state of the electronic device when the mount portion is rotating around the rotation axis, wherein a ratio is calculated by a module in the processor between the measured accelerations of the first and second accelerometers, and when the ratio is approximately equal to a predetermined ratio between the first and second distances, the module determines that the measured accelerations correspond to a rotation of the mount and wherein the mount portion rotates around a first rotation axis in a clockwise or counterclockwise direction and a second rotation axis around a second rotation axis in an upward or downward direction.

16. The electronic device of claim 15, wherein:

the electronic device is a night vision device.

* * * * *